US005137135A

United States Patent [19]

Pietsch et al.

[11] Patent Number: 5,137,135

[45] Date of Patent: Aug. 11, 1992

[54] ESCALATOR STEP CHAIN ROLLER

[75] Inventors: Kurt Pietsch, Minden; Hans-Jirgen Langer, Hespe, both of Fed. Rep. of Germany

[73] Assignee: Otis Elevator Company, Farmington, Conn.

[21] Appl. No.: 668,529

[22] Filed: Mar. 13, 1991

[51] Int. Cl.[5] ..... B66B 23/12

[52] U.S. Cl. ..... 198/332; 198/326

[58] Field of Search ..... 198/326, 327, 330, 332, 198/333

[56] References Cited

U.S. PATENT DOCUMENTS

| | | | |
|---|---|---|---|
| 2,905,308 | 9/1959 | Hansen | 198/332 |
| 4,175,652 | 11/1979 | Satou et al. | 198/332 |
| 4,249,649 | 2/1981 | Kraft | 198/332 |

FOREIGN PATENT DOCUMENTS

| | | | |
|---|---|---|---|
| 0850542 | 7/1981 | U.S.S.R. | 198/326 |
| 0943165 | 7/1982 | U.S.S.R. | 198/326 |
| 0992378 | 2/1983 | U.S.S.R. | 198/326 |
| 0822959 | 11/1959 | United Kingdom | 198/332 |

*Primary Examiner*—Robert P. Olszewski
*Assistant Examiner*—James R. Bidwell
*Attorney, Agent, or Firm*—William W. Jones

[57] ABSTRACT

The step chain rollers for an escalator or moving walkway are provided with an annular elastomeric tread mounted on the rim of the roller. The roller rim is formed with a recess or groove which receives the tread. The main body of the roller is metal, and the side edges of the roller contact a side part of the escalator roller track as the roller moves along the track. Lateral guidance for the step chain is thus provided. By recessing the tread in the roller rim, an increase in the metal-to-metal side contact zone between the roller and track is provided resulting in longer roller lift. The sides of the tread are preferably offset from the sides of the roller recess to allow crack-free expansion of the tread to occur.

2 Claims, 2 Drawing Sheets

ESCALATOR STEP CHAIN ROLLER

DESCRIPTION

1. Technical Field

This invention relates to an improved escalator or moving walkway step chain roller which provides enhanced step chain guidance, and longer roller tread life.

2. Background Art

Escalator and moving walkway steps or treads are connected together by step chains which are entrained upon and driven by powered sprockets to move the steps or treads along their path of travel. The step chains are provided with rollers which move along tracks defining the path of travel of the steps. In one prior art system, the step chain roller tracks are provided with a vertical side wall which engages the sides of the step chain rollers. This track side wall is operable to guide and control lateral deflection of the step chain whereby the escalator steps have their lateral position controlled. In this way, gaps between the escalator steps and the balustrade skirts which flank the steps are controlled.

The prior art step chain rollers are formed from metal (typically aluminum) castings which are journaled on step axles connected to the step chains. The metal rollers are fitted with annular elastomeric treads which contact the roller tracks thereby providing a quieter escalator or moving walkway. The use of the elastomeric tread has lessened the area of metal-to-metal contact between the aluminum part of the roller and the track side wall, thus reducing the effectiveness of the side-to-side step movement control. The height of the side wall of the track cannot be increased to increase the area of the metal-to-metal contact because a higher track side wall interferes with bending of the step chains in the transitional zones of the escalator.

DISCLOSURE OF THE INVENTION

This invention relates to an improved escalator or moving walkway step chain roller which utilizes the elastomeric roller tread while at the same time increasing the area of metal-to-metal contact between the roller sides and the track side walls. In addition, wear and tear on the elastomeric roller treads is held to a minimum. The improved step chain roller is formed with the metal hub which has a circumferential groove or recess formed in its rim. The rim recess receives the elastomeric tread. The sides of the rim recess thus provide an increase in metal-to-metal contact between the roller and the track side wall, and the tread has a sufficiently large radial thickness so as to project out of the recess to contact the running surface of the tracks. If necessary to reduce stresses on the sides of the tread in the roller recess, the axial thickness of the tread can be made less than the width of the roller recess so that the sides of the tread do not touch the sides of the recess. This allows compression of the tread without concurrent edge stress.

It is therefore an object of this invention to provide an improved escalator or moving walkway step chain assembly which affords improved lateral control of the step tread movement.

It is a further object of this invention to provide a step chain assembly of the character described with rollers having an increased metal side wall area for restricting lateral step tread movement.

It is an additional object of this invention to provide a step chain assembly of the character described wherein the rollers are fitted with elastomeric track-engaging treads mounted in a recess on the roller circumference.

It is another object of this invention to provide a step chain assembly of the character described wherein minimal stress is imparted to the roller treads during operation of the escalator or moving walkway.

These and other objects and advantages of the invention will be more readily apparent from the following detailed description of a preferred embodiment of the invention when taken in conjunction with the accompanying drawings, in which:

BEST MODE FOR CARRYING OUT THE INVENTION

Figure 1:
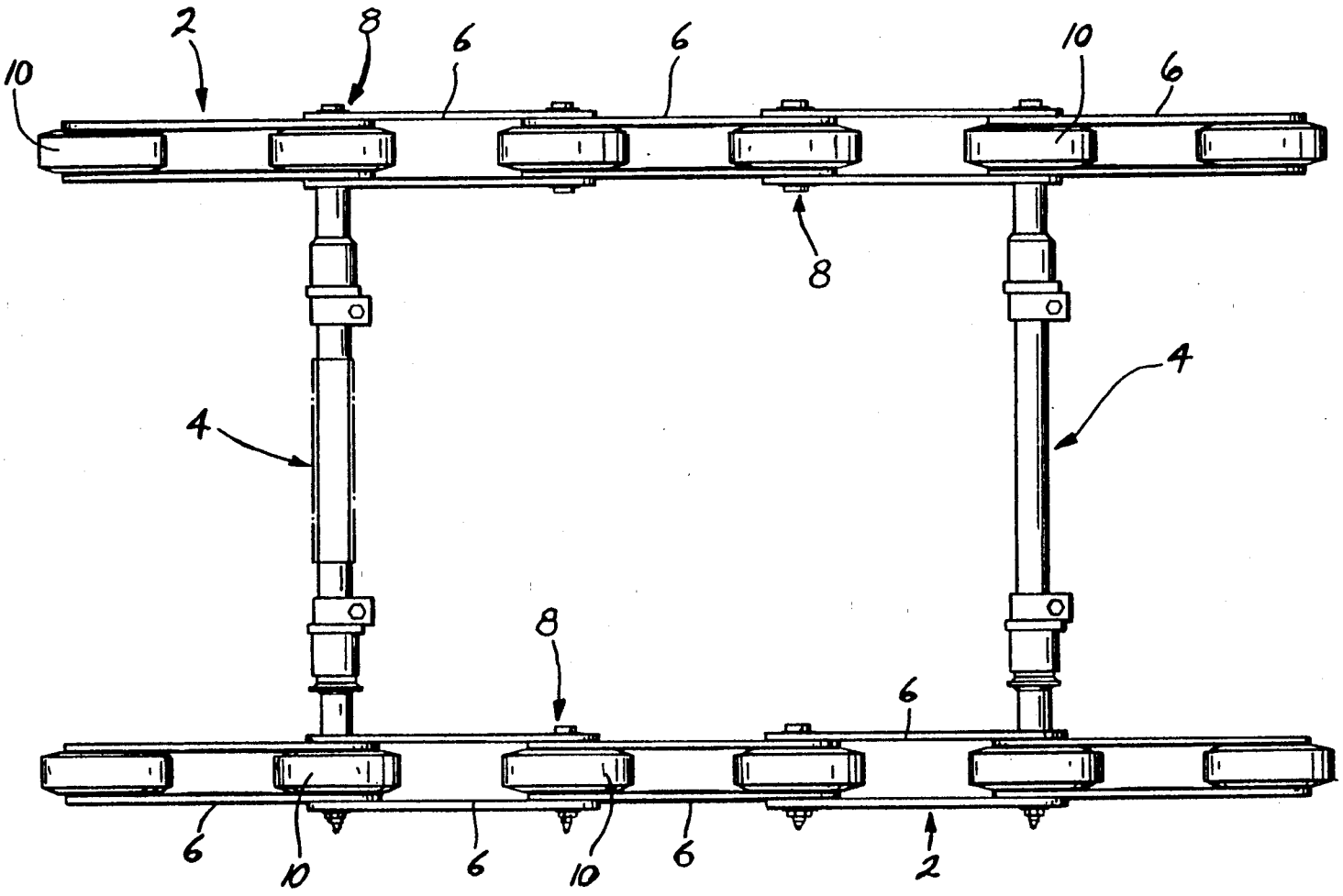
FIG. 1 is a plan view of a section of an escalator or moving walkway step chain showing how adjacent step axles are connected together by the chain, and showing where the step chain rollers are mounted on the step chain.

Referring to FIG. 1, there is shown a section of a conventional escalator or moving walkway step chain assembly, which includes two chains 2 which interconnect adjacent step axles 4. It will be understood that the escalator steps or walkway treads are mounted on the step axles 4. The step chains 2 have links 6 which are connected together at pivot joints 8. Step chain rollers 10 are journaled to the chains 2 at each pivot joint 8.

Figure 2:
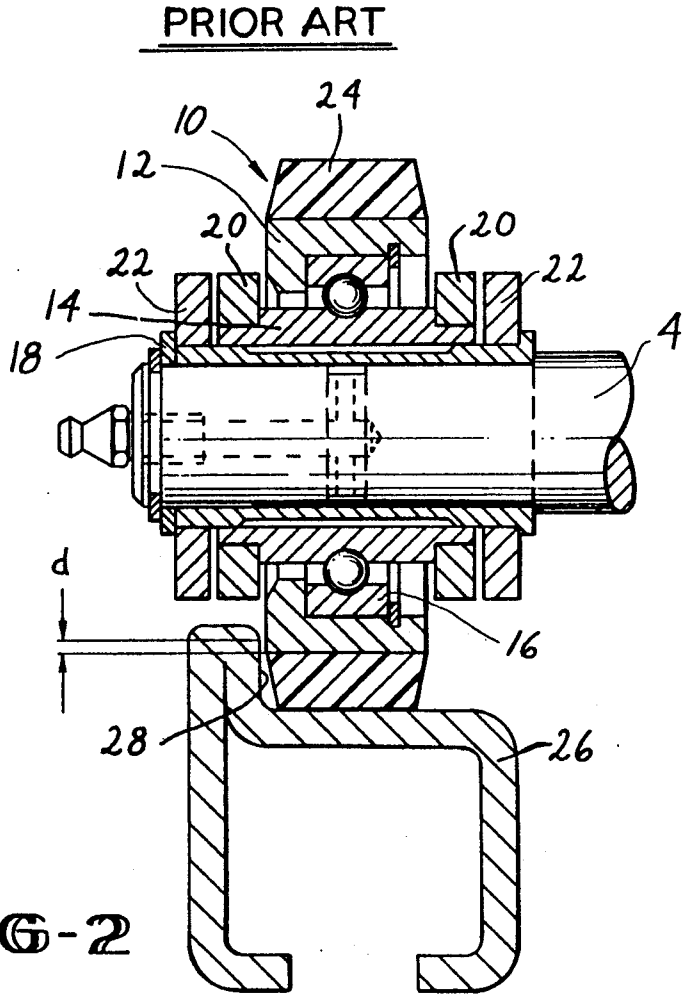
FIG. 2 is a fragmented sectional view through a step chain roller of the prior art showing how the roller engages the guide track.

As noted in FIG. 2, a typical prior art step chain roller 10 includes a metal hub 12 which is rotatably mounted on a sleeve 14 by means of a bearing 16. The sleeve 14 is mounted on a bushing 18 and the roller 10 and sleeve are held in place by stop rings 20 and 22, respectively. The metal hub 12 has an elastomeric tread or tire 24 mounted thereon. The tread 24 contacts the step roller track 26 and provides a quieter operation of the escalator or walkway. The track 26 has a side curb 28 which engages the roller hub 12 to control lateral movement of the escalator or walkway steps or treads. The use of the elastomeric tread 24 limits the extent to which the roller hub 12 is able to engage the track curb 28 to the relatively small dimension d. It would be advantageous to increase the extent of roller-to-curb contact to extend operational life and enhance control of lateral movement of the escalator steps, however, the height of the curb 28 cannot be increased because to do so would cause interference with chain link flexure by the curb in the escalator transition zones.

Figure 3:
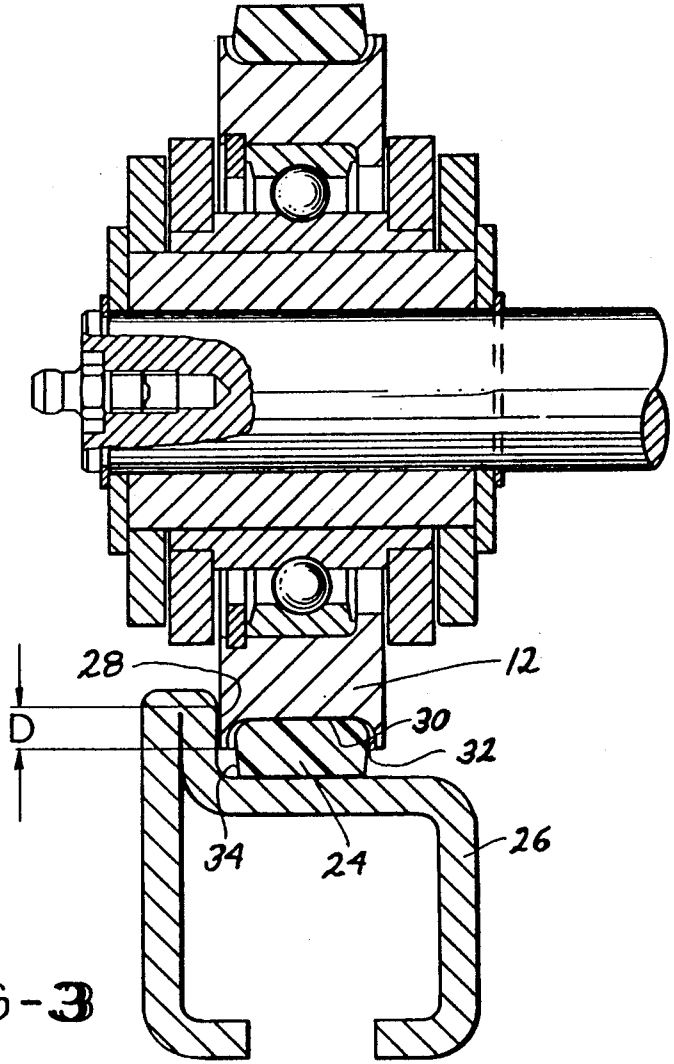
FIG. 3 is a view similar to FIG. 2 but showing the step chain roller of this invention.

FIG. 3 discloses the improved step chain roller of this invention which affords a larger area of contact between the roller hub 12 and the track curb 28. The hub 12 is provided with a circumferential groove 30 in which the elastomeric tread 24 is mounted. The sides 32 of the groove 30 are preferably spaced apart from the sides 34 of the tread 24. This allows flexure of the tread 24 to some extent in the groove 30. Allowing the tread 24 to freely flex laterally minimizes the stress imposed on the tread 24, and lessens the tendency of the tread 24 to crack or split. By placing the tread 24 in the hub groove 30, the extent of contact between the hub 12 and track curb 28 is increased from d to D. This provides the system with a longer operational life and a greater positive control over lateral movement of the steps or treads on the escalator or walkway.

It will be readily appreciated that the step chain roller assembly of this invention provides the quiet operation of the prior art, but with increased operating life and improved control over step and tread position. Stress-induced cracks and splits in the elastomeric roller tread are also minimized.

Since many changes and variations of the disclosed embodiment of this invention may be made without departing from the inventive concept, it is not intended to limit the invention otherwise than as required by the appended claims.

What is claimed is:

1. A guidance assembly for use in moving escalator steps or moving walkway treads along a given path of travel, said guidance assembly including a series of step axles interconnected by a pair of step chains having serial links joined by pivot joints, step chain rollers journaled on said step chains at said pivot joints, and guide tracks over which said step chain rollers move, one of said guide tracks having a side curb which provides lateral guidance for the step chain rollers characterized by said step chain rollers including a metal hub journaled on said pivot joints, said hub having a circumferential recess formed therein; an elastomeric tread disposed in said hub recess for contacting the track, said hub recess providing an increase in metal-to-metal contact between the track curb and the metal roller hub to provide improved lateral guidance of the step chains.

2. The assembly of claim 1 characterized by said tread having a width which is less than the width of the hub recess whereby the sides of the tread are spaced apart from the sides of the hub recess to provide zones for stress-free expansion of the tread in the recess.

* * * * *